United States Patent [19]

Liao

[11] Patent Number: 4,903,966

[45] Date of Patent: Feb. 27, 1990

[54] DEVICE FOR BATTING AND STRIKING PRACTICE

[76] Inventor: Leon Liao, No. 85-3, Yue Ming Street, Chung Chuean Li, Chunghwa, Taiwan

[21] Appl. No.: 341,831

[22] Filed: Apr. 24, 1989

Related U.S. Application Data

[63] Continuation-in-part of Ser. No. 194,089, May 16, 1988, abandoned.

[51] Int. Cl.[4] ..... A63B 69/36

[52] U.S. Cl. ..... 273/26 R; 273/29 A; 272/77; 272/78

[58] Field of Search ..... 273/26 R, 26 E, 185 D, 273/185 C, 200 R, 200 A, 58 C, 184 B, 200 B, 181 D, 29 A; 272/76, 77, 78

[56] References Cited

U.S. PATENT DOCUMENTS

| | | | |
|---|---|---|---|
| 4,508,340 | 4/1985 | Liao | 273/29 A |
| 4,531,734 | 7/1985 | Herrick | 273/29 A |
| 4,555,110 | 11/1985 | Hai-Ping | 273/200 B |

*Primary Examiner*—T. Brown

*Attorney, Agent, or Firm*—Zarley, McKee, Thomte, Voorhees & Sease

[57] ABSTRACT

A device for batting and striking practice having a base assembly to provide a firm support. The base assembly has a threaded hole for receiving a lower tube. A sleeve encompassing a set of packing rings and an intermediate tube constitute a height adjusting mechanism. The intermediate tube engages with a spring and a protective housing, which in turn engages with an upper tube. A variety of batting or striking bodies may be mounted on and engage with the spring.

8 Claims, 7 Drawing Sheets

DEVICE FOR BATTING AND STRIKING PRACTICE

BACKGROUND OF THE INVENTION

The present invention relates to a device for batting and striking practice used in practice for baseball, softball, tennis, boxing, etc.

This application is a continuation-in-part application of Ser. No. 194,089, filed May 16, 1988, now abandoned.

When a player practices batting or striking, it is necessary to have a device for practice. Conventional devices thus far have only provided one useful function. For example, a device for baseball hitting practice could not be used for boxing practice. In addition, conventional devices have had the following drawbacks:

(1) Device for practicing baseball or softball:

A player who uses the device must face toward a big tire. The tire being mounted on a trunk of a tree or some other column. When the baseball bat hits the tire, the tire can absorb only a part of the impact force. A great part of the impact force is returned to the player through the bat. As a result, the hands of the player receive a great shock and the hand muscles will be seriously damaged over a long period of use. Moreover, the player develops a fear of injury which detracts from the player's performance.

(2) Device for practicing tennis:

The device comprises a tennis ball and an electric wire connected between the ball and a fastening means on the ground. Since the wire must be long enough to imitate the true game, the space necessary for practice is large. The alternative to the above, gathering of loose tennis balls, is troublesome and time consuming.

Recently, some pitching devices have been developed for batting practice. These devices have a complex structure and the cost is high.

A further conventional device is shown in FIG. 7. This device comprises a base 9, a height adjusting bar 91 and a strut 92. The bar 91 and the strut 92 are mounted on respective sides of the base 9. An arm 911 which has a ball attached at the front end is connected to the bar 91. The lower end of the arm 911 is pivoted on an eccentric wheel frame 913 which supports an eccentric wheel 912. The strut 92 further comprises a resilient rubber piece 921 mounted on the top thereof. When used for practicing, the ball is hit and moved together with the arm 911 in the hitting direction and then returned to the original position by the resilient force of the rubber piece 921. It is obvious that this device can only be used for a limited number of practices.

SUMMARY OF THE INVENTION

The objective of the present invention is to provide a multi-function device for batting and striking practice.

A further objective of the present invention is to provide a device for batting and striking practice, which comprises a shock absorber to absorb the shock resulting from batting and striking.

Another object of the present invention is to provide a spring and protective housing which is easily engageable with various suitable batting or striking bodies.

Other objectives and advantages of the present invention will be clearly understood by those skilled in the art when the following detailed description of the best mode contemplated for practicing the invention is read in conjunction with the accompanying drawings wherein like numerals refer to like or similar parts throughout.

DETAILED DESCRIPTION OF THE DRAWINGS

Figure 1:
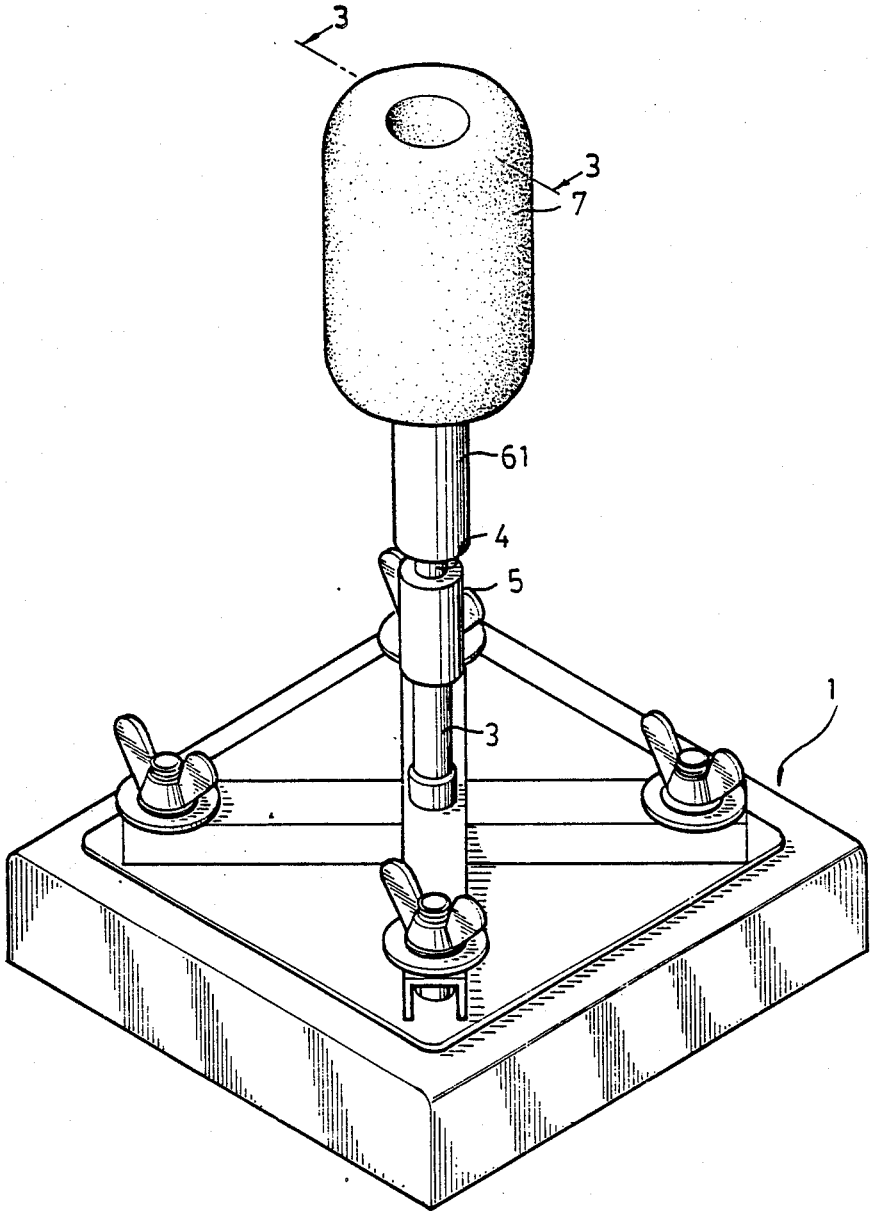
FIG. 1 is a perspective view of a device for batting and striking practice according to the present invention.
Figure 2:
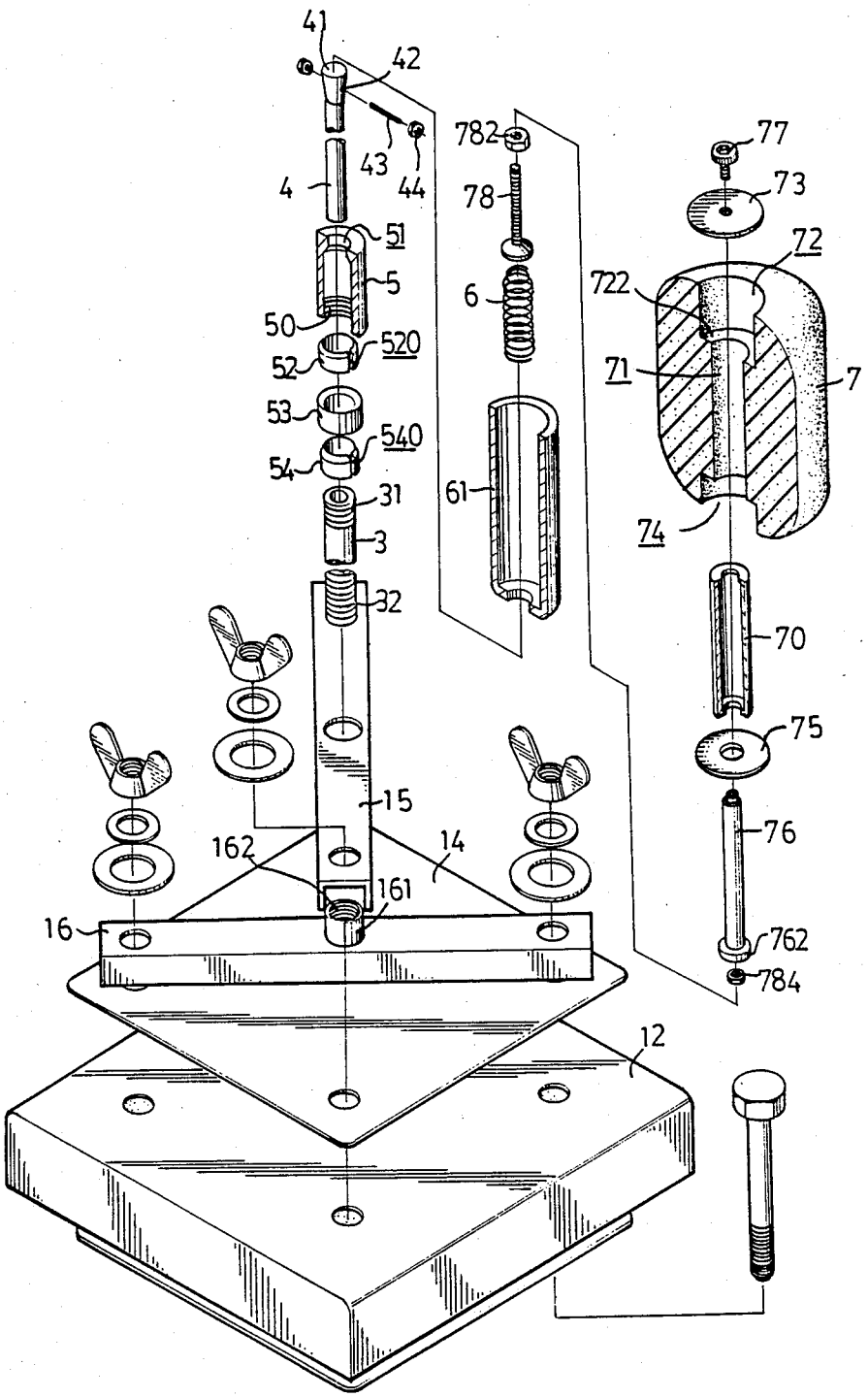
FIG. 2 is an exploded view of the device of FIG. 1.

Referring to FIGS. 1 and 2, it can be seen that the device according to the present invention comprises a base assembly 1, a lower tube 3, an intermediate tube 4, a sleeve 5, a spring 6 and a protective housing 61. The base assembly 1 threadedly receives a lower threaded end 32 of the lower tube 3 and comprises a pad 12, a base plate 14, a lower positioning channel member 16 and an upper positioning channel member 15. The pad 12 is preferably made of rubber and has a top surface slightly larger than that of the base plate 14. The lower positioning channel member 16 has a centrally fixedly disposed socket 161 with internally threaded hole 162 for threadedly receiving the lower tube 3. The base assembly 1 is constructed and assembled in a known way, as by providing a plurality of holes in conjunction with bolts and nuts, such that the lower tube 3 can be firmly secured thereto to provide a firm support for those elements connected to the lower tube 3.

Referring in particular to FIG. 2, the lower tube 3 also has an upper externally threaded end 31. The centrally bored sleeve 5 is cylindrical in shape and has an internally threaded end 50 at a lower section of the bore, while an upper section is tapered to a slightly narrower bored section 51. Disposed within the bore of the sleeve 5 is a set of packing rings 52, 53 and 54. All of the packing rings are cylindrical in shape and of such a size as to fit within the sleeve 5. Further, each of the packing rings is centrally bored to receive the intermediate tube 4. Packing rings 52 and 54 are additionally slotted along the length thereof (illustrated by 520 and 540 in FIG. 3 respectively). The upper surface of packing ring 54 and the lower surface of packing ring 52 are convexly conical toward the center of the rings. The packing ring 53 is a complete ring and concavely conical toward the center and engages with the surfaces of the packing rings 52 and 54.

Figure 3:
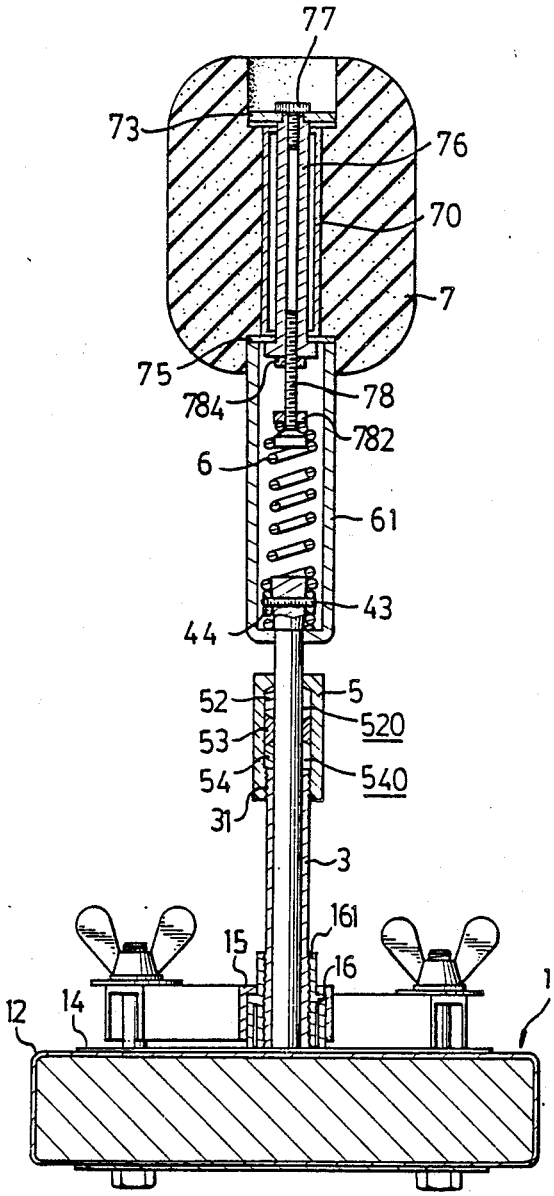
FIG. 3 is a longitudinal cross-sectional view of the device along line 3—3 of FIG. 1.

From the assembled cross-sectional view of FIG. 3, it can be seen that the intermediate tube 4 slidably inserts through the sleeve 5, the packing rings 52, 53 and 54 and the lower tube 3. As the sleeve 5 threadedly engages with the lower tube 3, the packing rings 52, 53 and 54 are compressed within the sleeve 5. Due to the conical shaped surfaces, packing rings 52 and 54 are forced to contract about the intermediate tube 4, thus holding it secure. It should also be noted here that the intermediate tube 4 is of sufficient length to afford a wide range of height adjustments to accommodate the height of the user and the desired practice function.

Referring again to FIGS. 3 and 4, a tapered head 41 is formed at an upper end of the intermediate tube 4. The protective housing 61 is made of a resilient material, such as rubber or the like, and is cylindrical in shape. The protective housing 61 also has a center hole at the lower surface thereof which receives the intermediate tube 4. Further, the protective housing 61 is centrally bored so that the spring 6 can be received therein. Additionally, the head 41 is pressed into the lower portion of the spring 6 and secured by the tension of the spring 6. A lateral through-hole 42 is preferably formed on the tapered head 41 which receives a threaded pin 43. By tightening nuts 44 from two ends of the threaded pin 43, a further securement is established.

An embodiment of a striking practice device is shown in FIGS. 1 through 3. In this particular embodiment a cylindrical shaped sponge-like material body 7 with a center hole 71 is mounted on the protective housing 61. The protective housing 61 is made of soft rubber-like material in order to protect the spring 6 located therein from damage and to protect the user from injury. The body 7 further comprises a first recess 72 on the upper surface for receiving a first washer 73 and a second recess 74 on the lower surface for receiving a second washer 75 as well as the protective housing 61. The first washer 73 bears against the lower surface 722 of the first recess 72. An upper tube 70 is received in the centrally bored hole 71 of the body 7. The upper tube 70 receives an inner tube 76 which has a flange 762 at the lower end thereof and an annular recess at the upper end thereof. The two ends of the inner tube 76 are internally threaded to accommodate a bolt 77 at the upper side and a bolt 78 at the lower side respectively. As shown in FIG. 3, the bolt 78 is disposed within the spring 6 and extends upwardly, engages a pair of nuts 782, 784 and further screws into the flange end 762 of the inner tube 76. It is noted that the length between the first washer 73 and the second washer 75 is slightly larger than the length of the upper tube 70, as well as the center hole 71, such that the body 7 is rotatably held above the protective housing 61 between the first and second washers 73, 75. As can be understood, the body 7 is kept in its position by the springs. When the body 7 is batted or struck, the protective housing 61 together with the spring 6 bends in the direction of the batting or striking.

Figure 4:
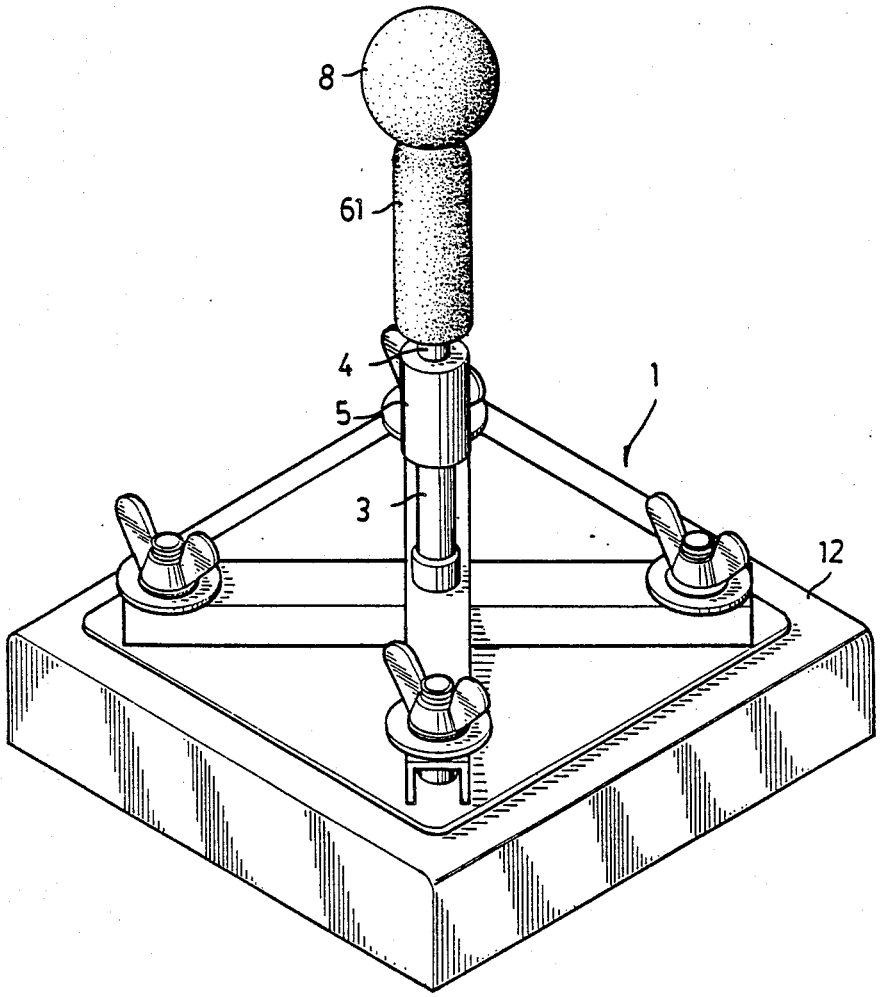
FIG. 4 is a perspective view showing a device according to the present invention for baseball batting practice.
Figure 5:
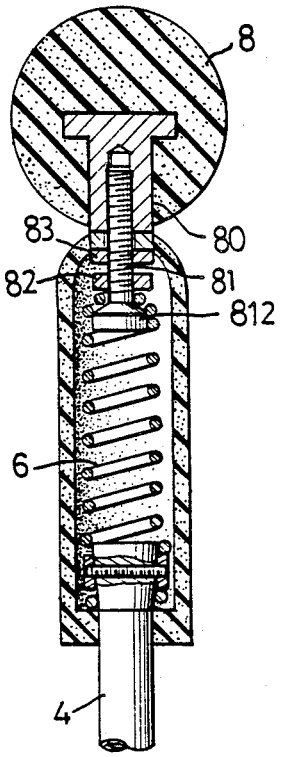
FIG. 5 is a partially enlarged cross-sectional view of the device of FIG. 4.

FIGS. 4 and 5 illustrate a design used for baseball or softball batting practice. As best seen in FIG. 4, the base assembly 1, the lower tube 3, the intermediate tube 4, the sleeve 5 and the spring 6, etc. are the same as those described in FIGS. 1 through 3, but with a ball-shaped body 8 substituted for the cylindrical body 7. The material of the ball-shaped body 8 is ideally rubber or like material with a cylindrical column 80 integrally molded therein. In the embodiment of FIGS. 4 and 5, the protective housing 61 is cylindrical in shape and tapers to an upper section of a slightly smaller diameter than the main portion. Referring to FIG. 5, the the cylindrical column 80 has a centrally threaded bore. A bolt 81 is disposed within the spring 6 and extends upwardly, engages a pair of nuts 82 and 83 and further extends into the cylindrical column 80. It should also be pointed out that the diameter of the uppermost turns of the spring 6 are reduced such that the inner diameter corresponds to the diameter of the bolt 81. The head 812 of the bolt 81 is of such size to fit within the spring 6 but not pass through the uppermost turns.

Figure 6:
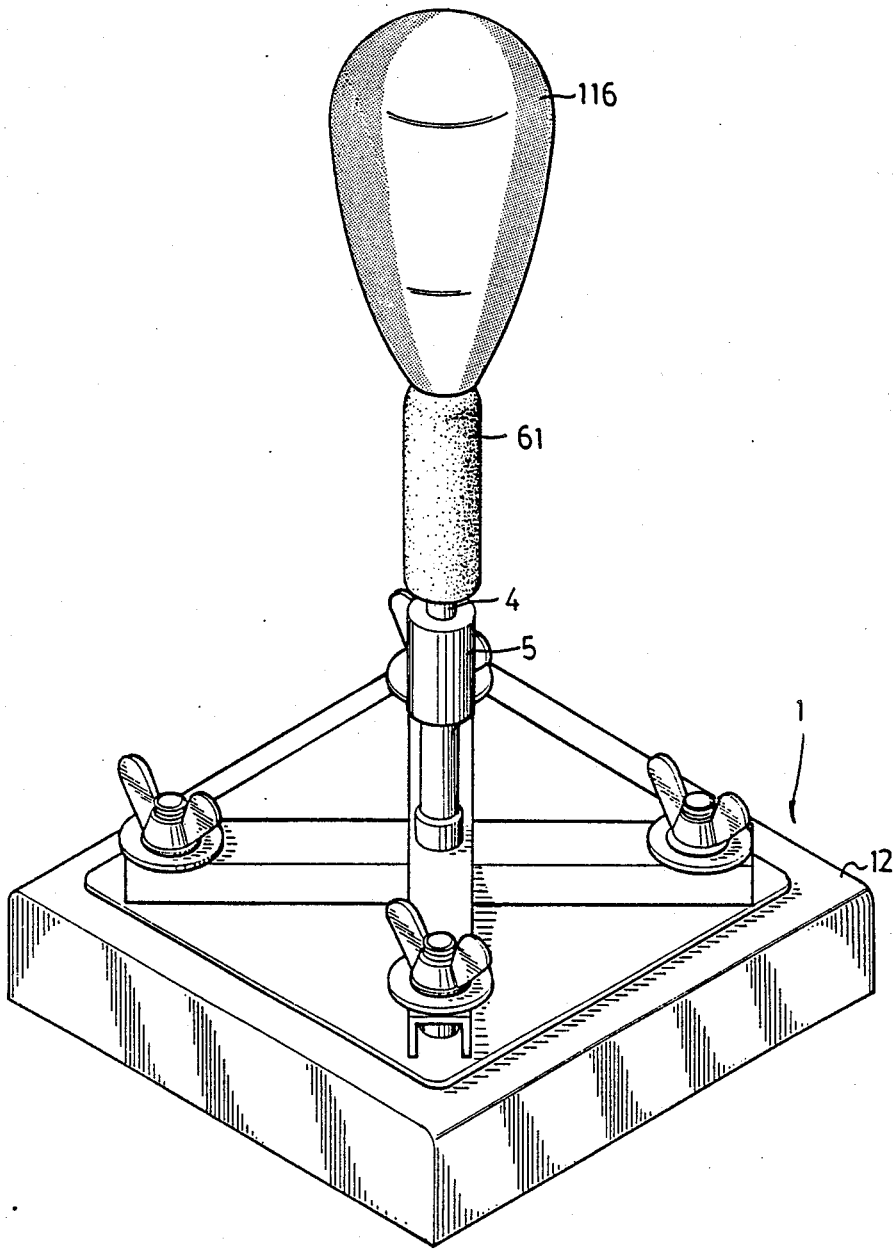
FIG. 6 is a perspective view showing a device according to the present invention for boxing practice.
Figure 7:
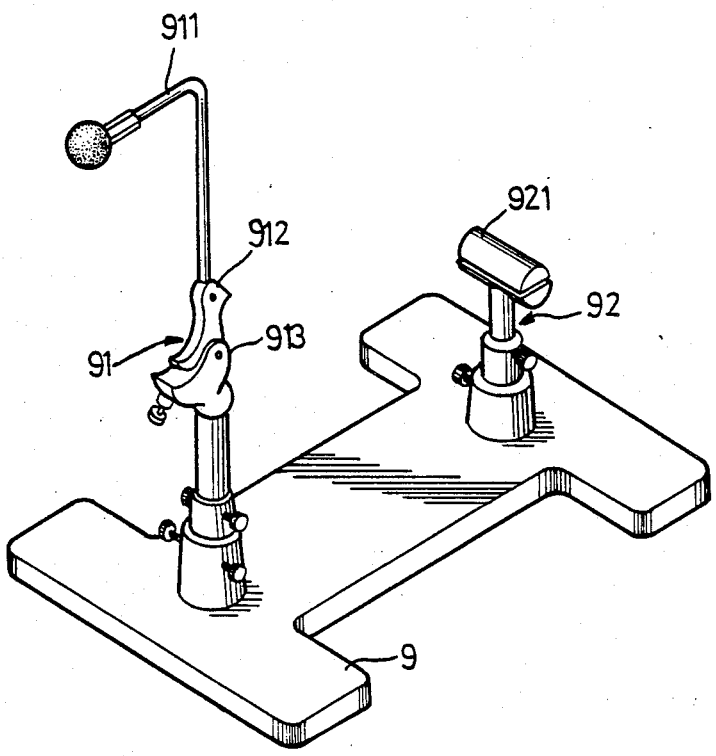
FIG. 7 PRIOR ART
FIG. 7 is a perspective view of a conventional batting practice device.

If a punching bag body 116 is substituted for the body 7 or ball-shaped body 8, as shown in FIG. 6, the device can be used for boxing practice. Based upon the preceding embodiments, the engagement of the device and the punching bag body 116 can be understood and achieved by a similar means.

It is therefore obvious for those skilled in the art that the device can engage with various practice bodies, so that the present invention can be considered a multifunctional practice device.

The above-mentioned embodiments of this invention are provided for illustrating the usage and structure of this invention, but do not limit the scope of the claimed invention. As various embodiments might be made of the above invention, it is to be understood that all matter herein described or shown in the accompanying drawings are to be interpreted as illustrative and not in a limiting sense. Thus it will be appreciated that the drawings are only exemplary of a preferred embodiment of the invention.

I claim:

1. A device for batting and striking practice having a base assembly to provide a firm support, said device comprising:

a lower tube having an upper threaded end and a lower threaded end, said lower threaded end being threadedly engaged to said base assembly;

a centrally bored sleeve being cylindrical in shape, said sleeve having an internally threaded end at a lower section thereof while an upper section being tapered to a slightly narrower bored section, said sleeve engaging with said upper threaded end of said lower tube at said internally threaded end;

a set of cylindrical packing rings being fitted within said sleeve, said packing rings being centrally bored to releasably secure an intermediate tube;

said intermediate tube being slidably inserted through said sleeve, said set of packing rings and said lower tube; said packing rings being compressed within the sleeve to contract about said intermediate tube when said sleeve threadedly engages with the lower tube; said intermediate tube having a tapered head at one end thereof for securely mounting a spring; said intermediate tube being of sufficient length to afford a range of height adjustments;

a cylindrical protective housing being centrally bored to receive said spring, said protective housing having a center hole at the lower surface thereof to accommodate said intermediate tube, said head of said intermediate tube being pressable into a lower portion of said spring secured by the tension of said spring;

a body assembly for practicing batting or striking being mounted on said protective housing, said body assembly being engaged with a bolt interconnects between said body assembly and an upper portion of said spring.

2. A device for batting and striking practice as claimed in claim 1, wherein said set of cylindrical packing rings comprises an upper packing ring, a lower packing ring and an intermediate packing ring, said upper and lower packing rings being slotted the length thereof, an upper surface of said lower packing ring and a lower surface of said upper packing ring being convexly conical toward the center of said set of rings, said intermediate packing ring being a complete ring and concavely conical toward the center and engages with said conical surfaces of said upper and lower packing rings.

3. A device for batting and striking practice as claimed in claim 1, wherein said tapered head of said intermediate tube has a lateral through-hole thereon receiving a threaded pin, said lower portion of said spring and said tapered head being secured by screwing nuts from two ends of said threaded pin.

4. A device for batting and striking practice as claimed in claim 1, wherein said protective housing is made of soft rubber material.

5. A device for batting and striking practice as claimed in claim 1, wherein said body assembly for practicing batting or striking comprises a cylindrical shaped sponge material body with a center hole, an upper tube and an inner tube, said body having a first recess on an upper surface thereof for receiving a first washer and a second recess on a lower surface thereof for receiving a second washer and an upper portion of said protective housing, said upper tube being received in said central hole of said body, said inner tube having two internally threaded ends, said bolt being interconnected between said upper portion of said spring and one of said two threaded ends of said inner tube, said body being rotatably held above said protective housing between said first and second washers.

6. A device for batting and striking practice as claimed in claim 5, wherein said inner tube has a flange at the lower threaded end and a recess at the upper threaded end, said bolt being disposed within said spring and extending upwardly, engaging a pair of nuts and further screwing into said flange end, the length between said first and second washers being slightly larger than the length of said upper tube and larger than said center hole, such that said body is rotatably held therein.

7. A device for batting and striking practicing as claimed in claim 1, wherein said body assembly for practicing batting or striking comprises a ball-shaped body, said ball-shaped body being preferably made of rubber material with a cylindrical column integrally molded therein, said cylindrical column having a centrally threaded bore, a bolt being disposed within said spring and extending upwardly, engaging a pair of nuts and further extending into said cylindrical column, the diameter of the uppermost turns of the spring having a reduced diameter such that the inner diameter of said spring corresponds to the diameter of the bolt, said bolt having a head with a diameter to fit within the spring but not pass through the uppermost turns.

8. A device for batting and striking practice as claimed in claim 7, wherein said body is a punching bag body engageable with the spring and protective housing.

* * * * *